US006062401A

United States Patent [19]

Hall et al.

[11] Patent Number: 6,062,401

[45] Date of Patent: May 16, 2000

[54] SHELVING SYSTEM

[76] Inventors: Donald M. Hall; Ross M. Hall, both of P.O. Box 1548,19 Progress St., Kingston, N.Y. 12401

[21] Appl. No.: 08/702,097

[22] Filed: Aug. 23, 1996

Related U.S. Application Data

[60] Provisional application No. 60/002,790, Aug. 25, 1995.

[51] Int. Cl.[7] ..... A47B 57/00

[52] U.S. Cl. ..... 211/187; 108/193; 108/144; 211/186

[58] Field of Search ..... 211/186, 187, 211/188, 126, 131; 108/193, 144

[56] References Cited

U.S. PATENT DOCUMENTS

| | | | |
|---|---|---|---|
| 2,739,777 | 3/1956 | Schoenhardt . | |
| 2,872,049 | 2/1959 | Slater . | |
| 2,941,775 | 6/1960 | Arnit . | |
| 3,263,821 | 8/1966 | Kleine . | |
| 3,375,936 | 4/1968 | Kessler . | |
| 3,379,190 | 4/1968 | Leach . | |
| 3,450,270 | 6/1969 | Brown . | |
| 3,603,274 | 9/1971 | Ferdinand . | |
| 3,702,137 | 11/1972 | Evans | 211/187 X |
| 3,770,135 | 11/1973 | Schild . | |
| 4,218,058 | 8/1980 | Hilbert et al. . | |
| 4,237,798 | 12/1980 | Welsch et al. | 108/144 X |
| 4,444,323 | 4/1984 | Travis . | |
| 4,582,001 | 4/1986 | Leikarts | 108/144 X |
| 4,754,712 | 7/1988 | Olson et al. | 108/144 X |
| 4,763,796 | 8/1988 | Flum | 211/186 X |
| 4,815,394 | 3/1989 | Ettlinger et al. | 108/144 X |
| 5,074,422 | 12/1991 | Hotz | 211/187 |
| 5,129,525 | 7/1992 | Maynard, Jr. | 211/187 X |
| 5,233,930 | 8/1993 | Wang | 211/186 X |
| 5,240,127 | 8/1993 | Levin et al. | 211/186 |
| 5,423,251 | 6/1995 | Kolvites et al. | 108/193 X |
| 5,601,038 | 2/1997 | Welch et al. | 108/193 |

FOREIGN PATENT DOCUMENTS

| | | |
|---|---|---|
| 766183 | 6/1934 | France . |
| 1068190 | 6/1954 | France . |
| 1342714 | 9/1963 | France . |
| 8302-767 | 3/1985 | Netherlands . |
| 376620 | 5/1964 | Switzerland . |
| 2181637 | 4/1987 | United Kingdom . |

*Primary Examiner*—Peter M. Cuomo
*Assistant Examiner*—Stephen Vu
*Attorney, Agent, or Firm*—Shlesinger, Arkwright & Garvey LLP

[57] ABSTRACT

The shelving system comprises a rear upright, the rear upright having a notch therein; a first shelf engaged with the notch and supported by said rear upright; a front post; and a member disposed between the rear upright and the front post at a lower portion thereof.

26 Claims, 7 Drawing Sheets

FIG. 3
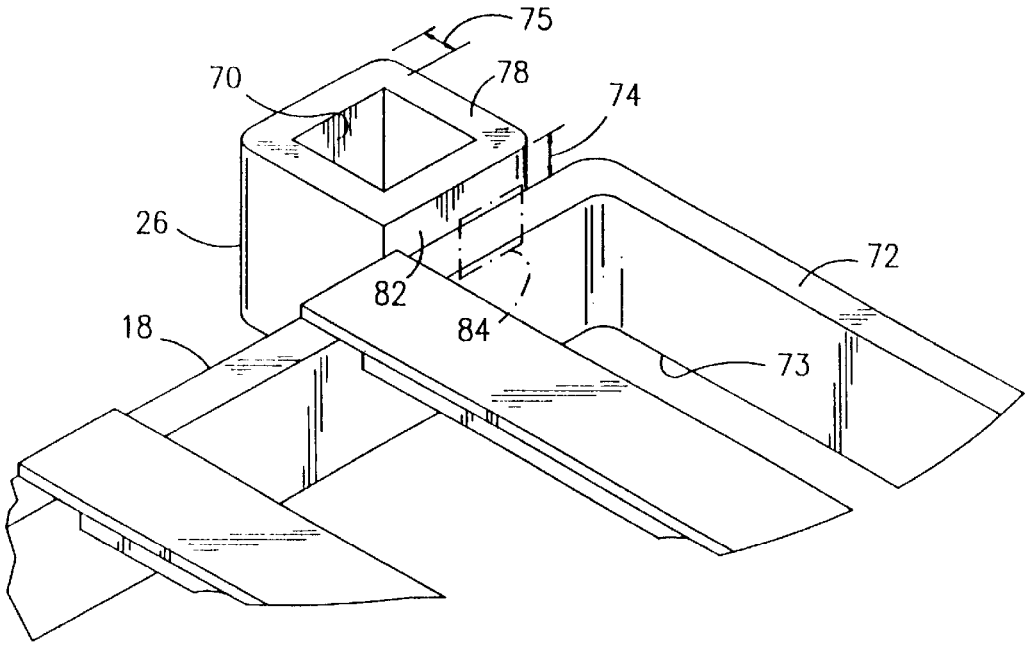
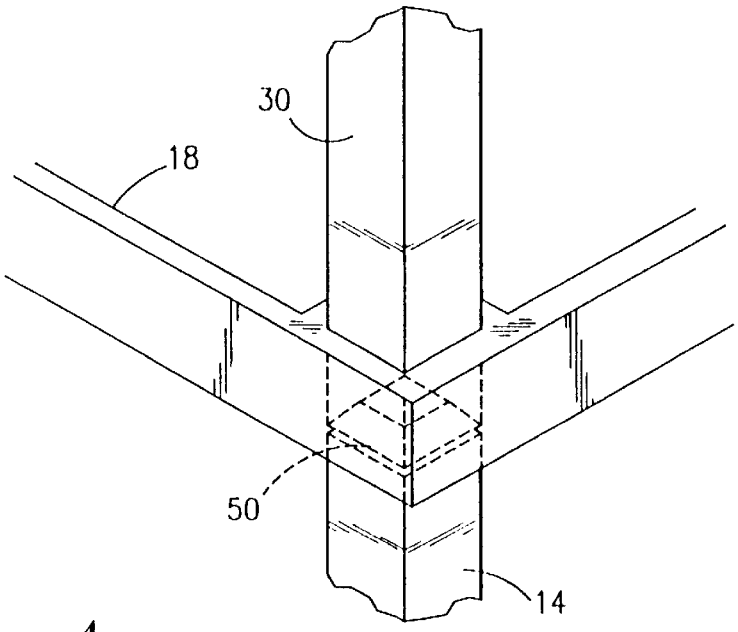
FIG. 4

FIG. 6
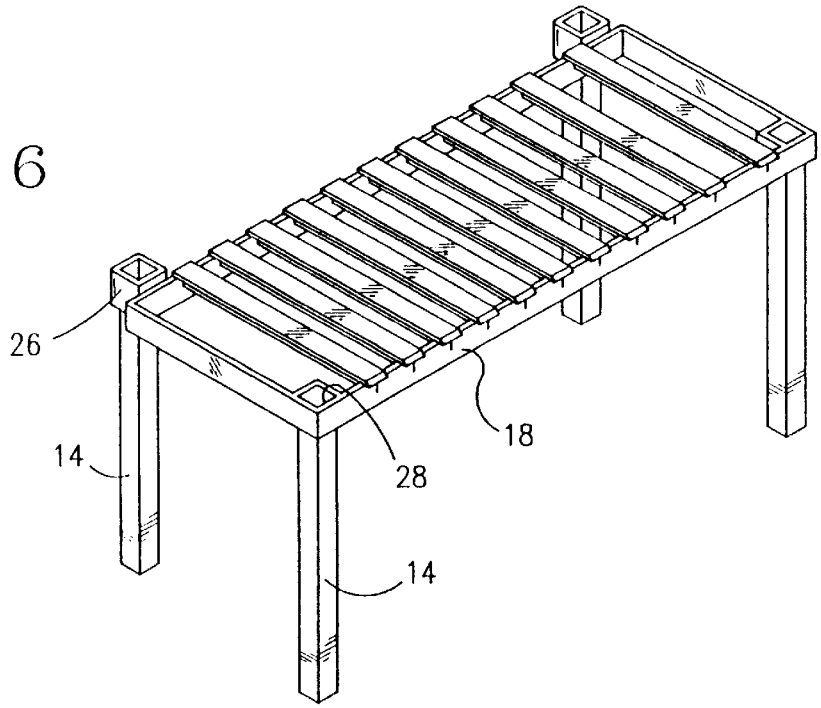
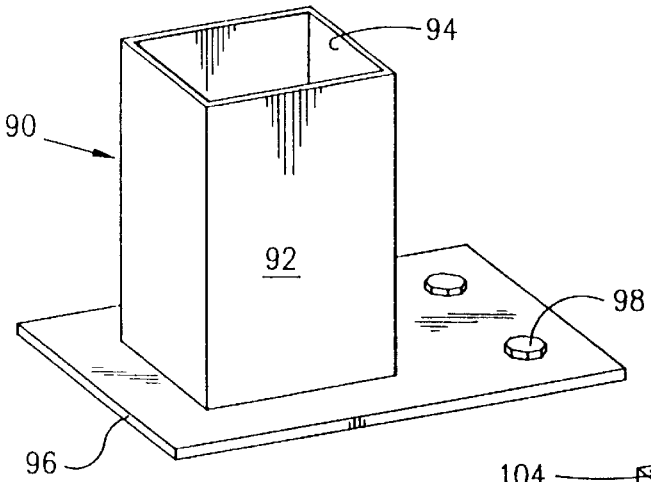
FIG. 7
FIG. 8
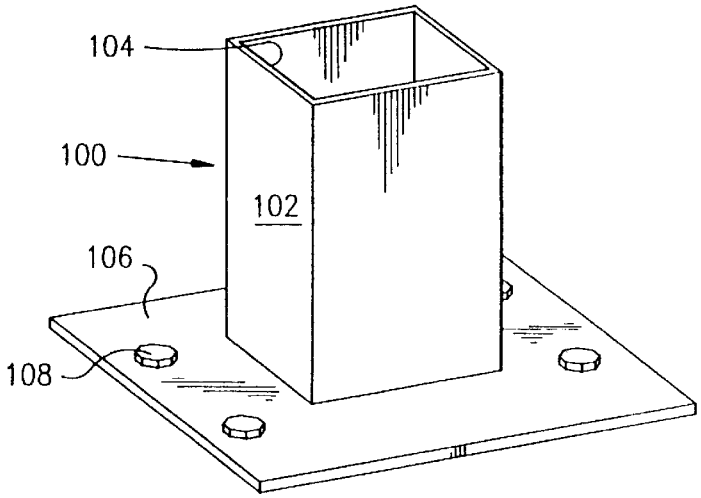

SHELVING SYSTEM

CROSS REFERENCE TO RELATED APPLICATIONS

This application claims the priority of Provisional Application No. 60/002,790, filed Aug. 25, 1995, which is incorporated herein by reference.

FIELD OF THE INVENTION

This invention relates to a shelving system. More particularly, this invention relates to a shelving system suited for holding and supporting objects.

BACKGROUND OF THE INVENTION

Shelving has long been used for supporting objects.

Known shelving devices are disclosed in, for example: U.S. Pat. No. 5,269,112 to Weinrub et al.; U.S. Pat. No. 5,074,422 to Holtz; and U.S. Pat. No. 3,424,315 to Farren.

Known shelving is frequently expensive to manufacture, unsuitable for various load and force requirements, difficult to use, and is difficult to assemble and disassemble.

OBJECTS AND SUMMARY OF THE INVENTION

Accordingly, it is an object of the invention to provide a shelving system which overcomes the drawbacks and disadvantages of prior art devices.

Another object of the invention is to provide a shelving system which can be easily and inexpensively manufactured.

Yet another object of the invention is to provide a shelving system which is strong, yet easily assembled.

Another object of the invention is to provide a shelving system which is easier to use than known devices.

A still further object of the invention is to provide a shelving system which can be made as either an integral shelving system or as a knock-down device.

Yet another object of the invention is to provide a shelving system which absorbs and transmits forces, such as laterally applied, vertically applied, and torsional forces, better than conventional devices.

A further object of the invention is to provide a shelving system which can be shipped in a disassembled condition so that shipping costs are reduced by the use of the United States Postal Service, common carriers, and the United Parcel Service (UPS), for example.

A still further object of the invention is to provide a shelving system which has more usable space than conventional holding devices.

A further object of the invention is to provide a shelving system stronger than known devices, yet which uses less expensive materials in its construction.

It is a still further object of the invention to provide a shelving system which has fewer and/or is free of fasteners and holes, such as are common in known assemblies.

Another object of the invention is to provide a shelving system having various components made of different materials that are readily assembled despite the provision of close tolerances to achieve a strong shelving system.

In summary, therefore, the invention is directed to a shelving system which is easier to use, is strong, is cost effective, is reliable, has increased holding capacity, is inexpensive to produce and ship, and better withstands forces of loading as well as external forces exerted on its elements, than known devices.

In summary therefore, the invention includes a shelving system, comprising a rear upright, the rear upright having a notch therein; a first shelf engaged with the notch and supported by said rear upright; a front post; and a member disposed between the rear upright and the front post at a lower portion thereof.

Throughout the specification, relative terms such as front and rear, and left and right, for example, are used for convenience, and are not intended to be limiting.

BRIEF DESCRIPTION OF THE DRAWINGS

FIG. 3 is a view of a detail of a socket and shelf according to the invention;

FIG. 4 is a view of a detail of a socket and shelf according to the invention, in use;

FIG. 6 is a perspective view of a dunnage rack according to the invention;

FIGS. 7 and 8 are perspective views of support feet in accordance with the invention;

DETAILED DESCRIPTION OF THE INVENTION

Figure 1:
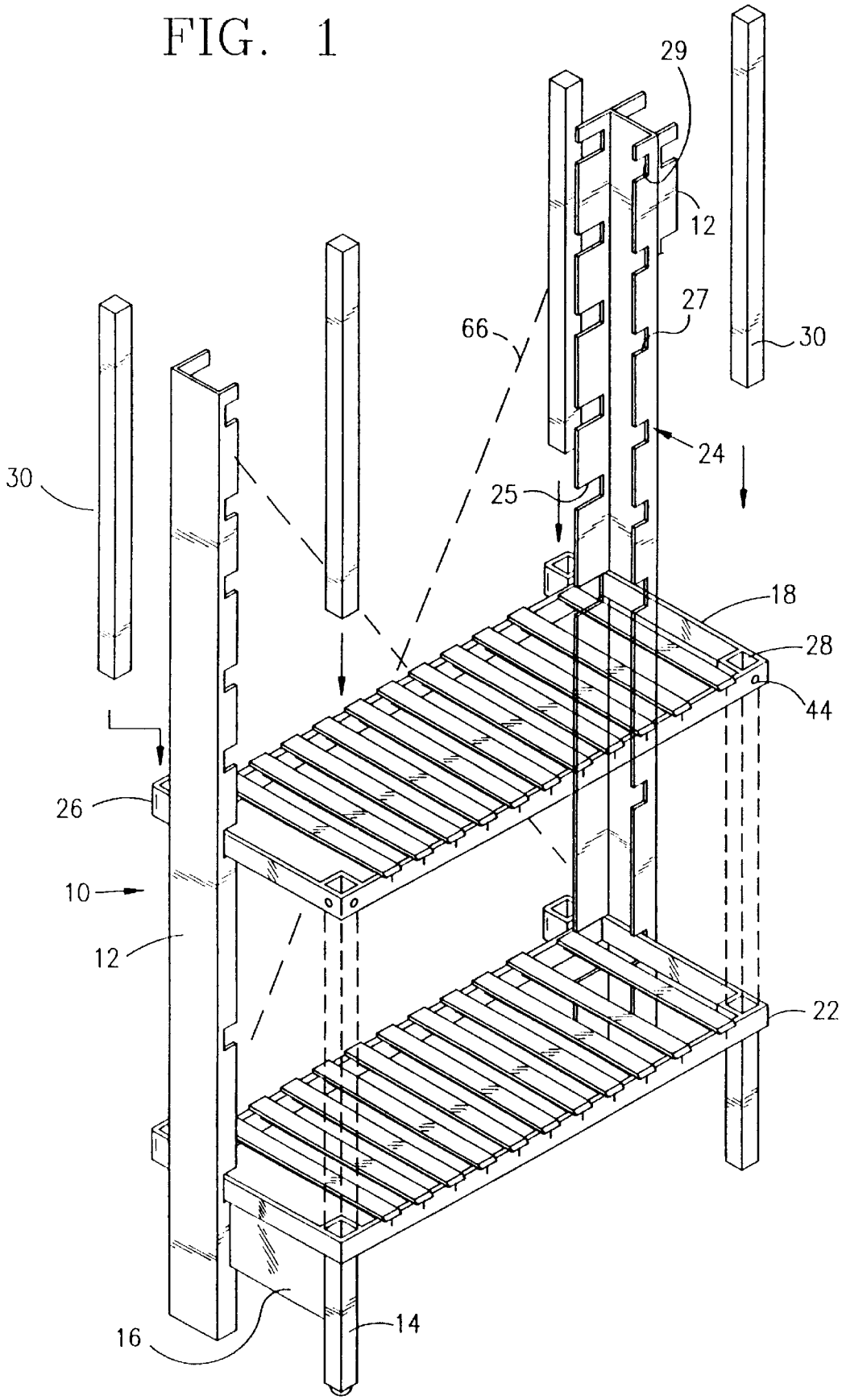
FIG. 1 is a perspective view of a preferred embodiment of a shelving system according to the invention.

FIG. 1 illustrates a first preferred embodiment of a shelving system or shelving 10 according to the invention.

Shelving system 10 includes a rear upright 12, and a front post 14. A structural member 16 may be provided between rear upright 12 and front post 14.

One or more shelves 18 having front sockets 22 are typically provided. Preferably, one or more notches 24 are provided on rear upright 12 configured to engage and support shelf 18. A downwardly facing free edge 25, an upwardly facing free edge 27, and a side edge 29 define socket 24.

A rear socket 26, as well as front socket 28 may likewise be provided.

One or more poles 30 are provided to support shelves 18.

Preferably, the outside diameter of poles 30 is configured to mate with a corresponding inner diameter of sockets 28. The outside diameter of front posts 14 is likewise configured to mate with the inner diameter of sockets 28.

Figure 2:
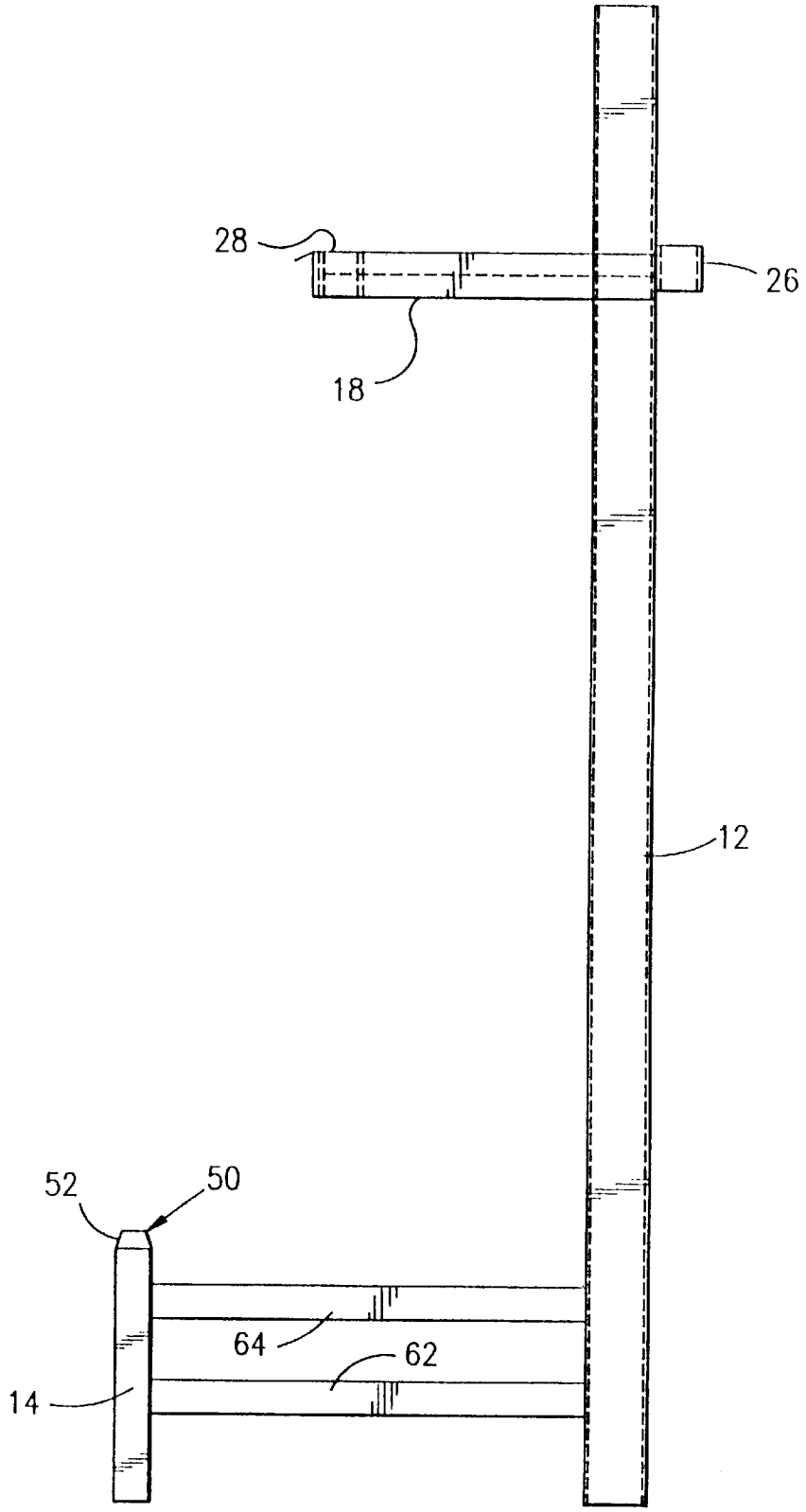
FIG. 2 is a side elevational view of a cantilever shelf upright according to the invention.
Figure 5:
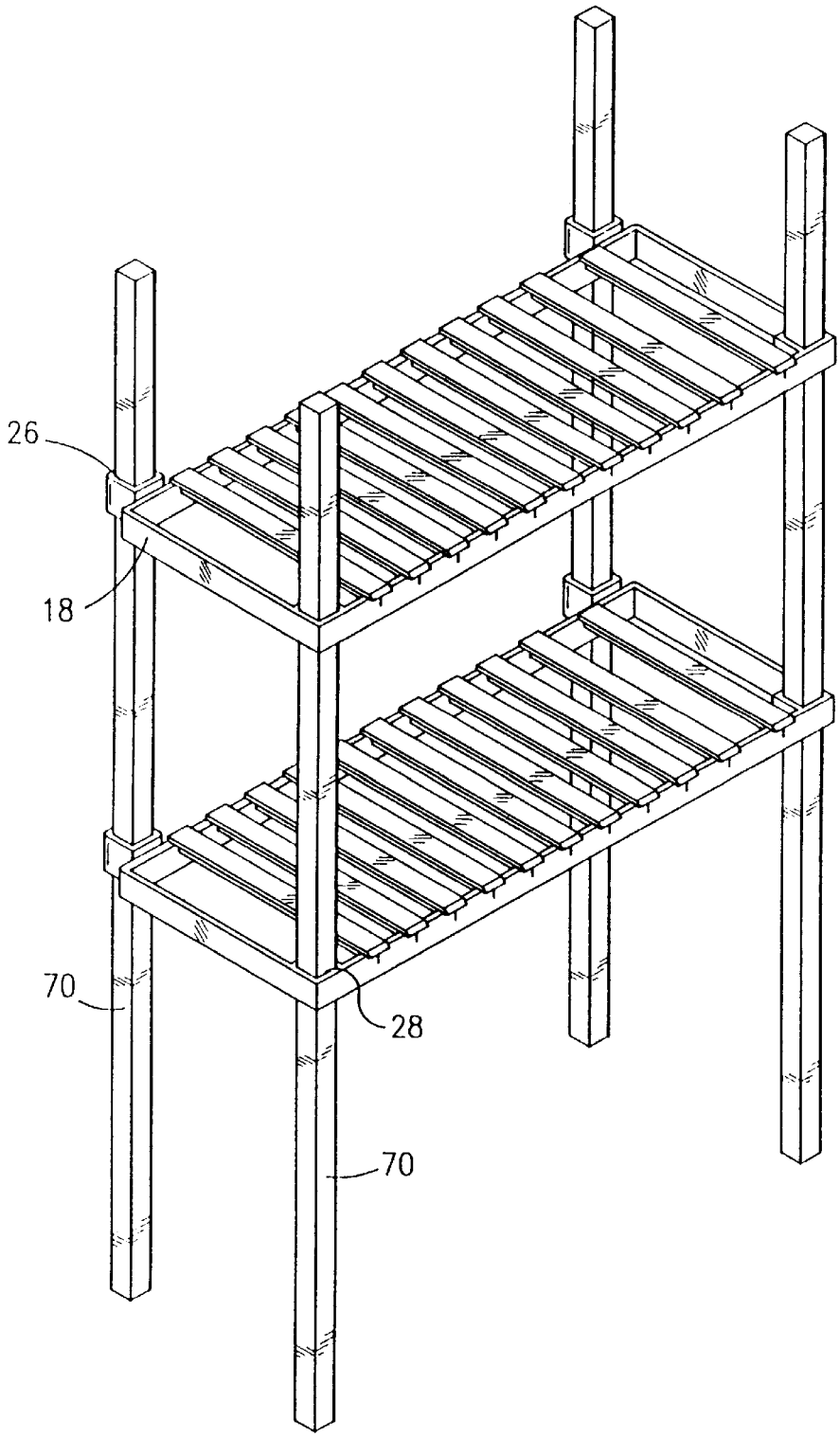
FIG. 5 is a perspective view of a stand-alone shelving system according to the invention.

Posts 14 may be provided with a reduced diameter free end or bullet nose 50 having an inwardly sloped face 52, as seen in FIGS. 2 and 4.

Good results have been achieved when front post 14 and poles 30 were made of elements having square cross sections, as opposed to the conventional circular cross sections or known shelves.

Accordingly, when front posts 14 have a square outer diameter, the bullet nose 50 has successfully been made with a sloped face 52 having the configuration of a truncated pyramid, as shown. In that manner, assembly of shelving system 10 is facilitated, even when the tolerances are close; i.e., when the outer diameter of post 14 and pole 30 are substantially the same as the inner diameter of sockets 28. Sloped face 52 assists with the alignment and insertion of posts 14 into socket 28.

FIG. 3 illustrates rear socket 26 having an inner diameter 70, which likewise preferably is sized to fit the outer diameter of poles 30.

Shelf 18 has a top face or surface 72 which may be substantially aligned with a bottom face 73.

The rear socket 26 may be offset above the top face 72 of shelf 18 so that an offset 74 between top surface 72 and a top surface 78 of socket 26 is realized. Offset 74 will also be used in conjunction with the embodiments of FIGS. 9 and 10 described below, for example.

Alternately, it is contemplated that each of the sockets on shelf 18 will be made similar to sockets 28.

Set screws 44 may be provided at various interfaces, as shown.

A pair of tubes 62 and 64 may be provided between posts 14 and upright 12, instead of and/or along with the use of flat member 16 of FIG. 1.

It should be noted that the use of poles 30 at the front and rear of shelving system 10 is optional.

Poles 30 extend between upper and lower shelves 18, as shown in phantom, and are disposed above front posts 14, when front posts 14 are in place.

Alternatively, it is contemplated that poles 30 be used in place of front poles 14 and extend from the supporting surface, through lower shelf 18 and up to upper shelf 18 in another embodiment.

When shelving system 10 is used as part of a row of shelves, an additional upright 12 will be placed adjacent to the right rear upright 12, as shown partially in phantom. It is contemplated that the pair of uprights 12 will be made as a single, integral h-shaped upright, instead of the two back-to-back c-shaped uprights 12 shown. An entire row of shelves 10 will be fashioned in that manner.

It is likewise contemplated that the x-brace 66 shown in phantom in FIG. 1 will be used under high load conditions to further strengthen shelving 10. X-brace 66 will be analogous to the x-brace as disclosed in the patents described above.

FIG. 6 illustrates dunnage rack or table made by use of posts 14 and shelf 18. It is likewise contemplated that flush mounted sockets 26 similar to front sockets 28 will be used instead of rear sockets 26. In the illustrated example, it is contemplated that the brackets of FIGS. 9, 10, and 11, as described in detail below, may be used to affix sockets 26 to a wall for added stability. In addition, the support feet of FIGS. 7 and 8 may be used.

FIG. 7 shows a shoe or duck foot 90 having a socket 92 with an inner diameter 94. An extension 96 may be fastened to the support surface by bolts 98. Typically, inner diameter 94 will be sized so as to mate with the outer diameter of the associated member being secured; e.g., the outer diameter of posts 14 and 30.

FIG. 8 shows a support foot 100 having a socket 102 defining an inner diameter 104 and an extension 106. Support shoe 100 may be secured to a surface by use of fasteners such as the illustrated bolts 108. Inner diameter 104 may be configured to mate with the outer diameters of posts 14 and 30, as with the embodiment of FIG. 7.

Figure 9:
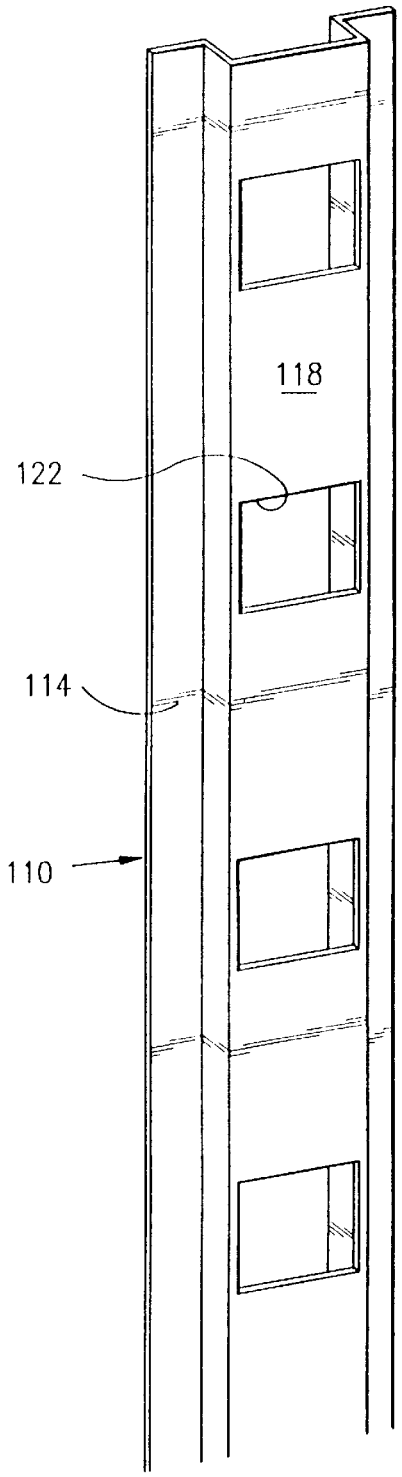
FIG. 9 is a perspective view of a wall bracket according to the invention.

FIG. 9 illustrates a wall mounting bracket 110 having one or more flanges 114 configured for engaging a wall. An outer wall 118 is provided with a plurality of notches 122 which are configured for mating with rear sockets 26, for example.

Figure 10:
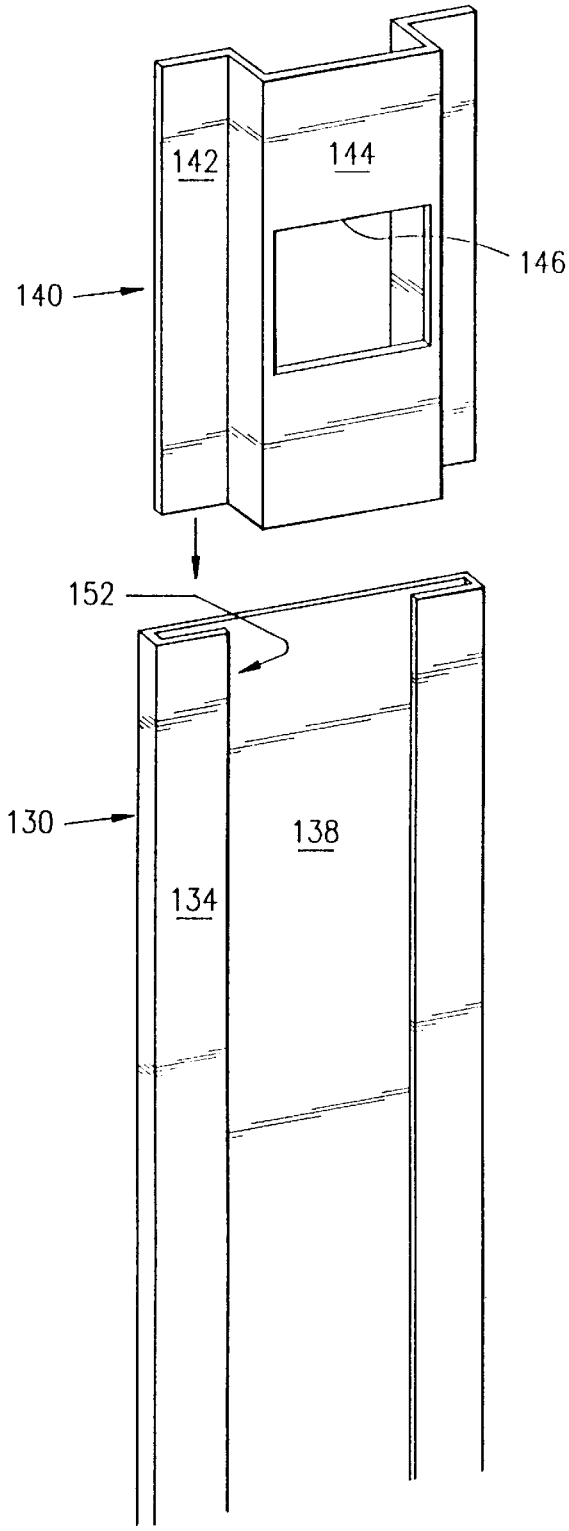
FIG. 10 is a perspective view of a further preferred embodiment of a wall bracket according to the invention.

FIG. 10 is a perspective view of an adjustable wall mounting bracket 130 having one or more flanges 134 spaced apart from a rear flange 138. An adjustable, notched mounting element 140 has one or more bottom flanges 142 and an outer wall 144 in which a notch 146 is defined.

The adjacent flanges 134 and 138 are offset so as to define one or more slots 152 into which flanges 142 may be inserted. Depending on the intended use, fasteners will then be attached to join elements 130 and 140 together, when notch 146 has been located at the desired height for supporting shelf 18.

Figure 11:
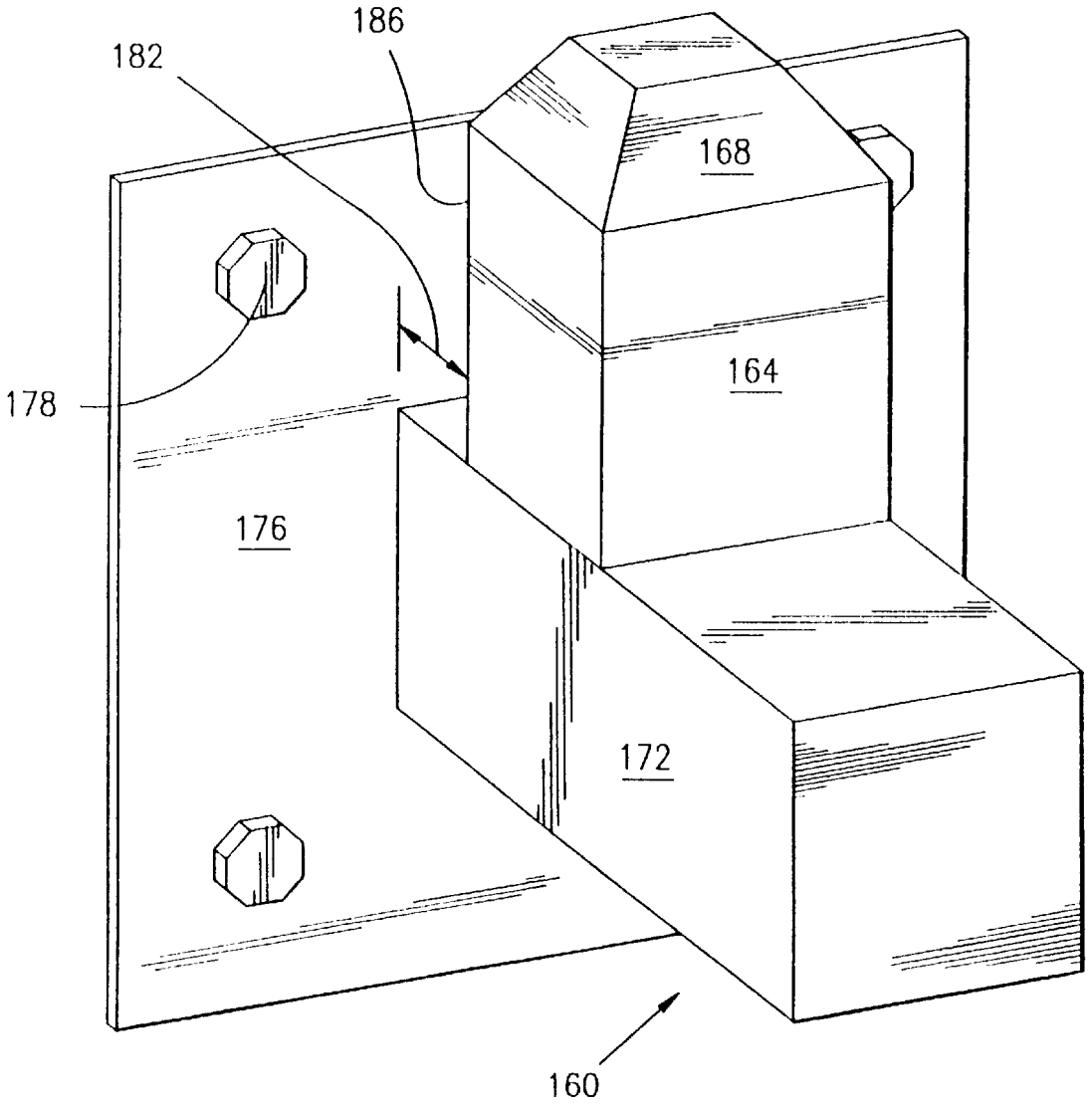
FIG. 11 is a perspective view of a still further embodiment of a wall bracket according to the invention.

FIG. 11 illustrates a single shelf bracket 160 having a pintle 164 thereon. Pintle 164 may be provided with a sloped surface 168. The outer diameter of pintle 164 may be sized so as to mate snugly with inner diameter 70 of socket 26. Likewise, sloped surface 168 is provided to enhance engagement of pintle 164 with socket 26.

Pintle 164 may be provided on an extension 172 attached to a mounting flange 176. Fasteners 178 may be used to secure flange 176 to the desired surface. A spacing or offset 182 between flange 176 and a rear face 186 of pintle 164 may be selected so as to mate with thickness 75 of socket 26, for example.

OPERATION

FIG. 1 illustrates a preferred use of shelving system 10 according to the invention, along with optional features.

The basic shelving system 10 includes upright 12, post 14 and shelf 18. Preferably, a connecting member 16 is likewise used. Upright 12, post 14 and member 16 can be made as an integral unit.

For heavy duty purposes, poles 30 may be added at the left front and/or right front of shelving system 10, the placement of poles 30 being shown in phantom line. Given close tolerances between the mating elements, as discussed above, set screws 44, and the like, are optional.

In other heavy duty use situations, left and/or right rear poles 30 can be inserted into rear sockets 26 of one or more shelves 18.

The use of front poles 30, as shown in phantom, is particularly suited for use at the end of rows of shelving in warehouses or grocery stores, for example, where fork lift trucks and the like are used. Front poles 30 assist in withstanding blows from such fork lifts. Cross brace 66 shown in phantom may likewise be used to further strengthen the shelf.

When shelving system 10 is used in a long row of shelving; i.e., when there are multiple shelving systems 10 placed side by side, the uprights 12 of adjacent shelving systems 10 may be joined together. In such a case, it is contemplated that poles 30 will be used at the front shelving system 10 for at least the shelving system 10 which is adjacent the aisle where carts and fork lifts are likely to strike shelving system 10.

In use, one of the many advantages of shelving system 10 is the provision of upwardly offset socket 26 which engages the rear face of upright 12 directly above slot 24 so as to prevent forward movement of shelf 18. Face 82 also acts with upper surface 72 to engage the portions of upright 12 which partially define the c-channel 24; e.g., the surface defining top edge 25 of notch 24.

When optional catch 84 is used, the space between catch 84 and face 82 above upper surface 72 defines a slot in which upright 12 is received. In that manner, shelf 18 is prevented from moving rearwardly out of engagement with upright 12, such as when shelf 18 is unloaded and easily moved. An upper portion of catch 84 may be bent outwardly away from socket 26 to facilitate engagement of upright 12.

By use of the two (2) opposed c-shaped open notches 24 cut in front and rear walls of upright 12, many advantages result. Even given flat shelves 18 constructed with substantially parallel top and bottom surfaces, the top surface 72 of shelf 18 engages upright 12 along the downwardly facing free edge 25, as described above, and, concurrently, the opposed, lower face 73 of shelf 18 engages upwardly facing free edge 27 of the c-shaped notch 24 in the front one of the cooperating pair of notches 24. Thus, when shelf 18 is in place, and under load, shelf 18 is not easily moved, and the force of the load is directed upwardly on rear free edge 25 and downwardly on front free edge 27 of paired notches 24, thus taking advantage of the strength of upright 12.

As shown in FIG. 4, when tolerances are selected so that the outer diameter of pole 30 and the inner diameter of socket 28 closely fit, the lower free end of pole 30 need not contact the bullet nose 50 received in the same socket.

It is contemplated that when tubing is used for pole 30, there may be a mating surface formed on the end of pole 30 shown adjacent bullet nose 50 in FIG. 4 so that the two engage directly.

In use, the mounting bracket 110 of FIG. 9 will typically be attached to a wall by fasteners placed through flange 114, and socket 26 will be inserted into aperture 122, so that the force of the shelf weight acting through socket 26 will be directed at the rear of front wall 118 above the aperture 122 in use.

The mounting bracket 130 of FIG. 10 is used in a manner similar to that of the bracket of FIG. 9, after locating element 140 at the desired position, as described above. Mounting bracket 130 may be oriented horizontally or vertically for example. In a horizontal application, element 140 may require a different configuration of notch 146.

Alternatively, it is contemplated that catch 84 be eliminated in favor of offsetting socket 26 away from the rear of shelf 18. In that manner, a portion of upright 12 engages between such an offset face 82 of socket 26 and the rear of shelf 18. Thus, it may be required to dimension one or more of rear free edges 25, 27, or 29 to be disposed between such an offset face 82 and the rear of shelf 18, in use.

In use, the single shelf bracket of FIG. 11 is mounted on a wall, for example, at the desired location, and socket 26, for example, is placed over pintle 164, as will be readily appreciated.

It is contemplated that the shelving system be made of various materials, such as stainless steel, aluminum and composites.

It is further contemplated that all manner of connecting joints be used, as well as all manner of sockets.

The shelf surfaces may be constructed of various flat stock, tubular stock, extrusions, and structural shapes, as required for various applications.

While this invention has been described as having a preferred design, it is understood that it is capable of further modification, uses and/or adaptations of the invention following in general the principle of the invention and including such departures from the present disclosure as come within the known or customary practice in the art to which to invention pertains and as may be applied to the central feature hereinbefore set forth, and fall within the scope of the invention and of the limits of the appended claims.

What is claimed is:

1. A shelving system, comprising:

a) a rear upright, said rear upright having a notch therein;

b) a first shelf engaged with said notch and supported by said rear upright;

c) at least one rear socket being provided on said first shelf;

d) said rear socket being configured for receiving a post therethrough and adjacent to said rear upright;

e) at least one front socket being provided on said first shelf;

f) said front socket being configured for receiving a post therethrough and being disposed at a distance from said rear socket;

g) a second shelf being disposed above said first shelf;

h) a second shelf engaged with said notch and supported by said rear upright;

i) at least one rear socket being provided on said second shelf;

j) said rear socket being configured for receiving a post therethrough and adjacent to said rear upright;

k) at least one front socket being provided on said second shelf;

l) said front socket being configured for receiving a post therethrough and being disposed at a distance from said rear socket; and m) a front post engaged with said front socket of said first shelf and with said front socket of said second shelf.

2. The shelving system as in claim 1, wherein:

a) a shelf bracket is provided for engaging said first shelf.

3. The shelving system as in claim 2, wherein:

a) a movable element having an aperture therein is provided on said shelf bracket; and b) said aperture is configured for engaging said shelf.

4. The shelving system as in claim 1, wherein:

a) a support foot is provided on a lower end of at least one of said rear upright and said front post.

5. The shelving system as defined in claim 1, wherein:

a) said front socket has a substantially rectangular opening therein for receiving said front post.

6. The shelving system as defined in claim 1, wherein:

a) said front socket has a substantially rectangular opening therein for receiving said front post.

7. The shelving system as defined in claim 1, wherein:

a) a catch is provided on said first shelf for preventing movement of said first shelf out of engagement with said rear socket.

8. The shelving system as defined in claim 1, wherein:

a) a wall mountable pintle is provided for receiving said at least one rear socket.

9. The shelving system according to claim 1, wherein:

a) a connecting member is disposed between said rear upright and said front post.

10. A shelving system as defined in claim 1, wherein:

a) a shelf bracket is provided for engaging said first shelf.

11. The shelving system as in claim 10, wherein:

a) said shelf bracket includes a bullet nose which engages said rear socket.

12. A shelving system as defined in claim 10, wherein:

a) said shelf bracket engages said rear socket.

13. A shelving system as defined in claim 12, wherein:

a) said shelf bracket detachably engages said rear socket.

14. A shelving system, comprising:

a) a rear upright, said rear upright having a notch therein;

b) a first shelf engaged with said notch and supported by said rear upright;

c) at least one rear socket being provided on said first shelf;

d) said rear socket being configured for receiving a post therethrough and adjacent to said rear upright;

e) a catch being provided on said first shelf for preventing movement of said first shelf out of engagement with said rear socket;

f) at least one front socket being provided on said first shelf;

g) said front socket being configured for receiving a post therethrough;

h) a front post;

i) said front post engaging said front socket;

j) a second shelf being disposed above said first shelf;

k) a rear post; and l) said rear post engaging said rear socket.

15. A shelving system as defined in claim 14, wherein:

a) a front socket is provided on said second shelf;

b) said front socket is configured for receiving a front pole therethrough; and c) a front post is disposed in said front socket of said first shelf and in said front socket of said second shelf.

16. A shelving system as defined in claim 15, wherein:

a) said front post includes an upper post disposed between said first and second shelves and a lower post disposed below said first shelf.

17. A shelving system as defined in claim 14, wherein:

a) said catch is disposed forwardly of said rear socket.

18. A shelving system as defined in claim 14, wherein:

a) said first shelf has an upper face; and b) said catch extends above said upper face of said first shelf.

19. A shelving system, comprising:

a) a rear upright, said rear upright having a notch therein;

b) a first shelf engaged with said notch and supported by said rear upright;

c) said first shelf having front, rear, left, right, and upper faces;

d) a second shelf disposed above said first shelf;

e) a left rear socket being provided on said first shelf;

f) said left rear socket being disposed inwardly of said left face of said first shelf;

g) said left rear socket extending above said upper face of said first shelf;

h) said left rear socket being configured for receiving a post therethrough and substantially adjacent to said rear upright;

i) at least one front socket provided on said first shelf;

j) said front socket being configured for receiving a post therethrough;

k) a front post;

l) said front post engaging said front socket;

m) a connecting member being disposed between said rear upright and said front post;

n) a rear post; and o) said rear post engaging said left rear socket.

20. The shelving system as defined in claim 19, wherein:

a) said front socket has a substantially rectangular opening therein for receiving said front post.

21. The shelving system as defined in claim 19, wherein:

a) a catch is provided on said first shelf for preventing movement of said first shelf out of engagement with said rear socket.

22. A shelving system as defined in claim 19, wherein:

a) said rear upright includes a left rear upright and a right rear upright;

b) a right rear socket is provided on said first shelf; and c) said right rear socket is configured for receiving a post therethrough and substantially adjacent to said right rear upright.

23. A shelving system as defined in claim 19, wherein:

a) said rear post includes a left rear post and a right rear post; and b) said right rear post engages said right rear socket.

24. A shelving system as defined in claim 19, wherein:

a) said front post includes a bullet nose.

25. A shelving system, comprising:

a) a left rear upright and a right rear upright, each said left and right rear uprights having a notch therein;

b) a first shelf engaged with the respective notches on said left and right rear uprights and being supported by said left and right rear uprights;

c) said first shelf having front, rear, left, right, and upper faces;

d) a left rear socket being provided on said first shelf;

e) said left rear socket being disposed inwardly of said left face of said first shelf;

f) said left rear socket extending above said upper face of said first shelf;

g) said left rear socket being configured for receiving a post therethrough and substantially adjacent to said rear upright;

h) a right rear socket being provided on said first shelf;

i) said right rear socket being configured for receiving a post therethrough and substantially adjacent to said right rear upright;

j) a front post;

k) a connecting member being disposed between said rear upright and said front post;

l) a left rear post and a right rear post;

m) said left rear post engaging said left rear socket; and n) said right rear post engaging said right rear socket.

26. A shelving system as defined in claim 25, wherein:

a) at least one front socket is provided on said first shelf;

b) said front socket is configured for receiving a post therethrough; and c) said front post engages said front socket.

* * * * *